US006335590B2

(12) United States Patent
Iwamura et al.

(10) Patent No.: US 6,335,590 B2
(45) **Date of Patent: *Jan. 1, 2002**

(54) CATHODE RAY TUBE HAVING AN INDIRECTLY HEATED CATHODE PROVIDED WITH A HEATER HAVING A STRUCTURE WHICH SUBSTANTIALLY PREVENTS CRACKS IN AN INSULATING COATING THEREOF

(75) Inventors: Norio Iwamura, Chousei-gun; Sachio Koizumi, Mobara, both of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/756,297

(22) Filed: Jan. 9, 2001

Related U.S. Application Data

(63) Continuation of application No. 09/216,969, filed on Dec. 21, 1998, now Pat. No. 6,191,528.

(30) Foreign Application Priority Data

Dec. 22, 1997 (JP) ..... 9-353155

(51) Int. Cl.[7] ..... H01J 29/10; H01J 1/14

(52) U.S. Cl. ..... 313/446; 313/270; 313/271; 313/37; 313/337

(58) Field of Search ..... 313/446, 346 DC, 313/346 R, 341, 344, 345, 337, 340, 37, 270, 271

(56) References Cited

U.S. PATENT DOCUMENTS 3,895,249 A 7/1975 Andre et al.
5,729,082 A 3/1998 Snijkers
5,959,398 A 9/1999 Snijkers et al.

FOREIGN PATENT DOCUMENTS

| | | |
|---|---|---|
| JP | 57-34671 | 7/1982 |
| JP | 7-254352 | 10/1995 |
| KR | 1990-0003176 | 5/1990 |

*Primary Examiner*—Michael H. Day
*Assistant Examiner*—Joseph Williams
(74) *Attorney, Agent, or Firm*—Antonelli, Terry, Stout & Kraus, LLP

(57) ABSTRACT

A cathode ray tube include phosphor screen and an electron gun. The electron gun includes an indirectly heated cathode structure and plural grid electrodes arranged in axially spaced relationship. The cathode structure includes a base metal having an electron emissive material coating and a heater for heating the base metal. The heater includes a major heating portion having a spirally wound heating wire and a pair of leg portions connected to opposite ends of the major heating portion. The major heating portion and an inner portion of each of the leg portions on a major-heating-portion side thereof are covered with an insulating coating, and the heater is welded to electrical conductors for applying a voltage thereto at an outer portion of each of the leg portions, the outer portion not being covered with the insulating coating. The outer portion of each of the leg portions includes a first multilayer winding portion having heating wires wound spirally in plural layers, and the inner portion of each of the leg portions includes a second multilayer winding portion having heating wires wound spirally in plural layers. The number of turns per unit length in the first multilayer winding portion is smaller than that in the second multilayer winding portion.

7 Claims, 9 Drawing Sheets

CATHODE RAY TUBE HAVING AN INDIRECTLY HEATED CATHODE PROVIDED WITH A HEATER HAVING A STRUCTURE WHICH SUBSTANTIALLY PREVENTS CRACKS IN AN INSULATING COATING THEREOF

CROSS REFERENCE TO RELATED APPLICATION

This is a continuation of U.S. application Ser. No. 09/216,969, filed Dec. 21, 1998, now U.S. Pat. No. 6,191,528, the subject matter of which is incorporated by reference herein.

BACKGROUND OF THE INVENTION

The present invention relates to a cathode ray tube and particularly to a cathode ray tube provided with a heater having improved immunity against mechanical shock caused in the operation of welding the heater to heater supports in fabrication of an indirectly heated cathode structure and having improved immunity against adverse effects caused by thermal expansion in a manufacturing process of a cathode ray tube.

In general, color cathode ray tubes such as a color picture tube and a color display tube comprise an evacuated envelope (a glass bulb) formed of a panel portion having a faceplate, a neck portion and a funnel portion for connecting the panel portion and the neck portion, a phosphor screen formed on an inner surface of the faceplate including a multiplicity of phosphor elements of three colors, a shadow mask having a multiplicity of apertures therein and spaced from the phosphor screen in the panel portion, a three-beam in-line electron gun housed in the neck portion for generating three electron beams and projecting the electron beams through the shadow mask to the phosphor screen, an inner magnetic shield of generally truncated pyramidal shape extending from the interior of the funnel portion into the panel portion and having openings on the shadow mask side thereof and the electron gun side thereof, and a deflection device mounted in a vicinity of a transition region between the funnel portion and the neck portion.

Three electron beams emitted from the electron gun are deflected appropriately by the deflection device, travel through the inner magnetic shield, pass through beam apertures in the shadow mask, impinge upon the phosphor screen and excite the phosphor elements of desired colors to generate light and to display a desired image on the faceplate.

The three-beam in-line electron gun housed in the neck portion includes three indirectly heated cathodes arranged in a line, and the first, second, third, fourth, fifth and sixth grid electrodes arranged in axially spaced relationship in this order on the electron beam exit side of the three indirectly heated cathodes. Each indirectly heated cathode includes a metal sleeve, a cap-shaped base metal having an electron emissive material coating on an outer top surface thereof and fitted over one end of the metal sleeve, a heater positioned within the metal sleeve, and heater supports each having a cross section of the shape of a square bracket and welded to a leg portion of the heater.

FIGS. 3A, 3B and 3C are schematic illustrations of a prior art indirectly heated cathode structure for a cathode ray tube, FIG. 3A being its cross sectional view, FIG. 3B being a plan view, partly broken away, of a heater of the cathode structure, and FIG. 3C being an enlarged view of a portion of the heater indicated by circle 60 in FIG. 3B.

In FIGS. 3A, 3B and 3C, reference numeral 31 denotes a metal sleeve, 32 is a cap-shaped base metal, 33 is an electron emissive material coating, 34 is a heater, 35 is heater supports, 36 is a heating wire, 37 is an insulating coating, 38 is a dark color coating, and 39 is leg portions of the heater 34.

The cap-shaped base metal 32 is fitted over one end of the metal sleeve 31 and is coated on its outer top surface with an electron emissive material layer 33.

The heater 34 comprises the spirally wound heating wire 36 made of tungsten (W), the insulating coating 37 made of alumina ($Al_2O_3$) and covering the heating wire 36 and the dark color coating 38 made of fine tungsten powders and covering the insulating coating 37.

The heater 34 is provided with a major heating portion formed of the heating wire 36 spirally wound and is inserted into the metal sleeve 31. The leg portions 39 of the heater 34 comprise a covered portion 39A covered with the insulating coating 37 and the dark color coating 38 and an exposed portion 39B with the heating wire 36 being uncovered. The exposed portions 39B are welded to one end of the two heater supports 35, respectively.

The metal sleeve 31 is supported concentrically with and within an outer support sleeve 40 which in turn is supported by glass beads 41.

The heater supports 35 are supported by the glass beads 41 via support studs 42 such that the major heating portion of the heater 34 is positioned within the metal sleeve 31.

The major heating portion of the heater 34 is formed of the heating wire 36 spirally wound, and each of the leg portions 39 of the heater 34 is of the three-layer winding form in which the heating wire 36 is spirally wound in three layers by doubling back the heating wire 36 upon itself at each end of the leg portion 39.

Fabrication of the three-layer winding structure of the heating wire 36 in the leg portion 39 comprises winding first the heating wire 36 spirally at a fine pitch from one end of the leg 39 to the other end thereof, then doubling back the heating wire 36 and winding it spirally at a coarse pitch from the other end thereof to the one end thereof, and again doubling back the heating wire 36 and winding spirally it at a fine pitch from the one end thereof to the other end thereof. This structure of multilayer winding of the heating wire is hereinafter referred to as the primary winding structure.

The heating wire 36 formed into the primary winding structure is again wound spirally to form the major heating portion of the heater 34 to be positioned within the metal sleeve 31. This structure of the large-diameter spiral winding of the heating wire of the major heating portion is hereinafter referred to as the secondary winding structure.

The heating wire 36 having the secondary winding structure is coated with alumina ($Al_2O_3$) except for the exposed portion 39B of the leg portions 39 of the heater 34, is covered with fine tungsten (W) powders on the alumina coating, and then is fired at a high temperature, 1650° C., for example. The fired heating wire 36 is immersed in a mixed solution of hydrochloric acid (HCl) and nitric acid ($HNO_3$) to dissolve molybdenum (Mo) having served as a mandrel for winding the heating wire and to complete the heater 34. The heater as described above is disclosed in Japanese Utility model Publication No. Sho 57-34671, for example.

The heater 34 has sufficient resistance to sparks and mechanical shock because of its three-layer winding structure of the heating wire 36 in its leg portions 39 and has good workability in the operation of welding the exposed portions 39B of the leg portion 39 to the heater supports 35.

SUMMARY OF THE INVENTION

Although the prior art heater of the three-layer winding structure for the indirectly heated cathode structure has a sufficiently high resistance to sparks and mechanical shock, the increased strength of the heater leg portions easily causes damages such as cracks in the insulating coating made of alumina ($Al_2O_3$) during the operation of welding the exposed portions to the heater supports.

There is a problem in that the damages such as cracks caused in the insulating coating extend and a portion of the insulating coating comes off in flakes when the heater is turned on during the operation of manufacturing a cathode ray-tube.

The flakes from the insulating coating scatter within the evacuated envelope of the cathode ray tube and degrade the performance of the cathode ray tube. The flakes stuck between electrodes of the electron gun deteriorate withstand voltage characteristics of the cathode ray tube, and the flakes stuck in beam apertures in the shadow mask of the cathode ray tube prevent phosphor elements associated with the beam apertures from luminescing.

An object of the present invention is to solve the above-mentioned problems of the prior art and is to provide a cathode ray tube which is free from peeling of the insulating coating of its heater and degrading its performance when the heater is turned on, and which is low-cost and superior in mass productivity.

To accomplish the above objects, according to a preferred embodiment of the present invention, there is provided a cathode ray tube comprising an evacuated envelope including a panel portion, a neck portion, a funnel portion for connecting the panel portion and the neck portion and a stem having a plurality of pins therethrough and being sealed to close the neck portion at one end thereof, a phosphor screen formed on an inner surface of the panel portion, an electron gun housed in the neck portion, the electron gun comprising an indirectly heated cathode structure and a plurality of grid electrodes disposed downstream of the cathode structure, spaced specified distances apart, arranged axially in a specified order, and fixed by insulating rods, the indirectly heated cathode structure comprising a metal sleeve, a base metal having an electron emissive material coating on an outer top surface thereof and attached at one end of the metal sleeve, and a heater positioned within the metal sleeve, wherein the heater comprises a major heating portion having a spirally wound heating wire and a pair of leg portions connected to opposite ends of the major heating portion, the major heating portion and an inner portion of each of the pair of leg portions on a major-heating-portion side thereof are covered with an insulating coating, the heater is welded to electrical conductors for applying a voltage thereto at an outer portion of each of the pair of leg portions, the outer portion not not covered with the insulating coating, the outer portion of each of the pair of leg portions includes a first multilayer winding portion having heating wires wound spirally in a plurality of layers, the inner portion of each of the pair of leg portions includes a second multilayer winding portion having heating wires wound spirally in a plurality of layers, a number of turns per unit length in the first multilayer winding portion is smaller than that in the second multilayer winding portion.

In the above construction, the heating wire in the exposed (uncovered) portions of the leg portions of the heater is wound with the number of turns per unit length smaller than that in the covered portion of the leg portions such that the mechanical strength of the exposed portion is made weaker. Consequently, this structure greatly reduces occurrences of damage such as cracking in the insulating coating in the covered portion of the leg portion and in a portion other than the leg portion during the operation of welding the exposed portions to the heater supports, and also greatly reduces deterioration of performance of cathode ray tubes caused by flakes coming off from the damaged insulating coating.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 4:
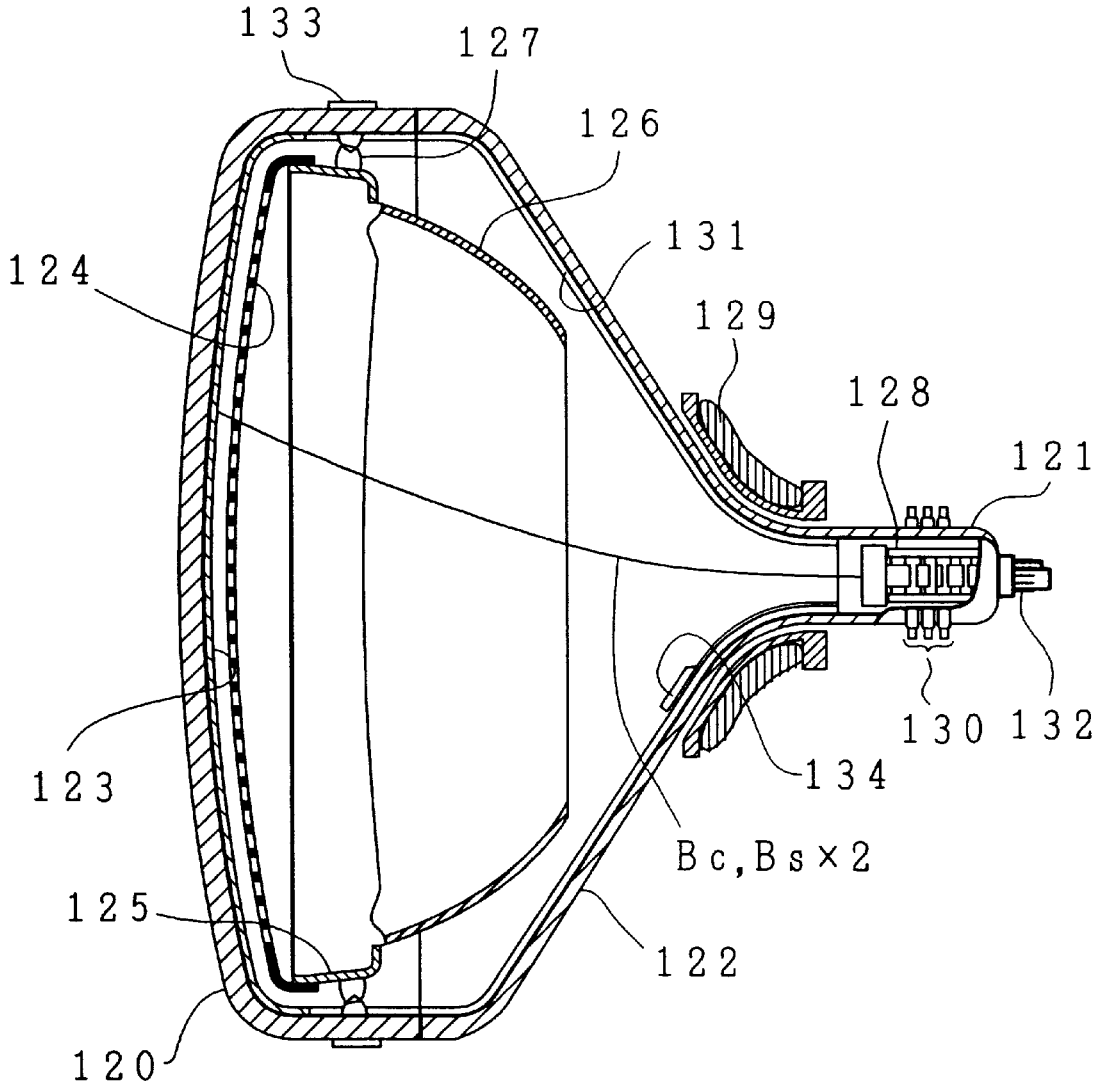
FIG. 4 is a schematic cross-sectional view for explaining a constitution of a shadow-mask type color cathode ray tube as an example of a color cathode ray tube to which the present invention is to be applied.

FIG. 4 is a schematic sectional view for explaining a structure of a shadow mask type color cathode ray tube as an example of a color cathode ray tube to which the present invention is to be applied, and reference numeral 120 denotes a panel portion, 121 denotes a neck portion, 122 denotes a funnel portion for connecting the panel portion 120 to the neck portion 121, 123 denotes a phosphor screen constituting An image screen formed on the inner surface of the panel portion 120, 124 denotes a shadow mask, i.e., a color selection electrode, 125 denotes a mask frame forming a shadow mask assembly holding the shadow mask 124, 126 denotes an internal shield for shielding the electron beams Bc, Bs from external magnetic fields, 127 denotes a spring suspension mechanism which suspends and supports the shadow mask assembly on studs heat-sealed to the inner side wall of the panel portion 120, 128 denotes an electron gun which emits three electron beams, Bs (×2) and Bc, 129 denotes a deflection device which deflects the electron beams Bc, Bs horizontally and vertically, 130 denotes an external magnetic correction device for performing color purity adjustment and beam centering correction, 131 denotes an internal conductive coating, 132 denotes stem pins through which various signals and operating voltages are supplied to the electron gun 128, 133 denotes an implosion protection tension band which holds the junction region of the panel portion 120 and the funnel portion 122 under tension, and 134 denotes a getter to obtain a high degree of vacuum within the vacuum envelope.

In the constitution as shown in FIG. 4, the vacuum envelope is comprised of the panel portion 120, the neck portion 121 and the funnel portion 122, and three electron beams, Bc and Bs×2, emitted in a line from the electron gun 128 are deflected in two directions of horizontal and vertical directions, by deflection magnetic fields generated by the deflection device 129 to scan the phosphor screen 123. Bc denotes a center electron beam and Bs denotes side-electron beams.

Three electron beams, Bs and Bs×2, are modulated respectively by three color signals, red (a side beam Bs), green (a center beam Bc,) and blue (a side beam Bs), supplied from the stem pins 132, and they are subjected to color selection in beam apertures in the shadow mask 124 disposed immediately in front of the phosphor screen 123 and reproduce a desired color image by impinging upon a red phosphor, a green phosphor and a blue phosphor of a mosaic three-color phosphor of the screen 123, respectively.

Electron beams are scanned over the whole phosphor screen 123 by horizontal and vertical deflection magnetic fields generated by the deflection device 129 on the way of movement from the electron gun 128 to the phosphor screen 123.

Figure 5:
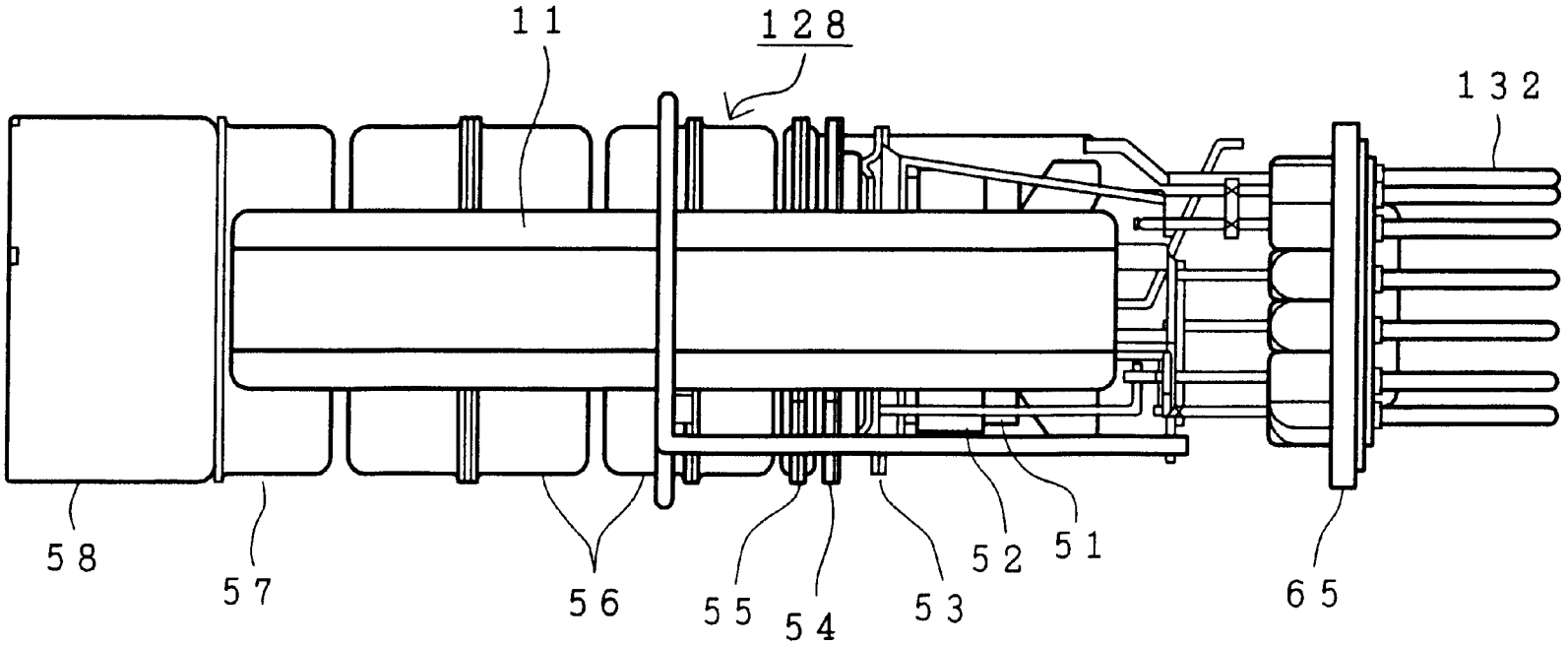
FIG. 5 is a side view for explaining an example of a constitution of an electron gun to be used for the color cathode ray tube of FIG. 4.

FIG. 5 is a side view for explaining a constitutional example of the electron gun 128 to be used for the color cathode ray tube of FIG. 4, wherein reference numeral 51 denotes an indirectly heated cathode structure, 52 denotes a first grid electrode, 53 denotes a second grid electrode, 54 denotes a third grid electrode, 55 denotes a fourth grid electrode, 56 denotes a fifth grid electrode, 57 denotes a sixth grid electrode, 58 denotes a shield cup, 11 denotes an insulating rod, 132 denotes stem pins and 65 denotes a stem.

The shield cup 58 is fixed on the sixth grid electrode 57 serving as an anode, and the first grid electrode 52 and the second to sixth grid electrodes 53 to 57 are mounted in predetermined coaxially axially spaced relationship in a specified order on a pair of the insulating rods 11 by tabs which are provided on the side wall of each of the electrodes and embedded in the insulating rods 11 made of multiform glass.

In one embodiment of the present invention, the indirectly heated cathode structure comprises a metal sleeve, a cap-shaped base metal having an electron emissive material coating on its outer surface and fitted over one end of the metal sleeve, a heater positioned within the metal sleeve, heater supports welded to respective leg portions of the heater for holding the heater in a predetermined position, each of the leg portions of the heater is formed of a heating wire spirally wound in a plurality of layers, comprises a covered portion covered with an insulating coating and an exposed portion with the heating wire being uncovered, and the number of turns per unit length, of the heating wire in the exposed portion is smaller than that in the covered portion.

In each of the following two embodiments, each heating wire is spirally wound in three layers.

In one specific embodiment of the present invention, the covered portion of the leg portions of the heater comprises superposition of two layers of the heating wire wound at a first pitch and one layer of the heating wire wound at a second pitch, the first pitch being smaller than the second pitch, and the exposed portion of the leg portions comprises three layers of the heating wire wound at the second pitch.

In another specific embodiment of the present invention, the covered portion of the leg portions of the heater comprises superposition of one layer of the heating wire wound at a first pitch and two layers of the heating wire wound at a second pitch, the first pitch being smaller than the second pitch, and the exposed portion of the leg portions comprises three layers of the heating wire wound at the second pitch.

In these embodiments of the present invention, the heating wire in the exposed (uncovered) portion of the leg portions of the heater is wound with the number of turns per unit length smaller than the number of turns per unit length in the covered portion of the leg portions such that the mechanical strength of the exposed portion is weaker than that of the corresponding portion of the prior art heater. Consequently, this structure reduces the transmission of stresses caused by heat of welding from the exposed portion to other portions of the heater during the operation of welding the exposed portions to the heater supports in fabrication of the indirectly heated cathode structure, and greatly reduces occurrences of damage such as cracks in the insulating coating in the covered portion of the leg portion and in a portion other than the leg portion. Resultant great reduction of flakes from the insulating coating damaged by turning on the heater 4 greatly reduces deterioration of performance of cathode ray tubes caused by scattering of the flakes within its vacuum envelope.

The embodiments of the present invention are different only in pitches of winding of the heating wire from the prior art heater and therefore they do not increase the cost or deteriorate mass productivity.

The embodiments of the present invention will be explained in detail hereunder with reference to the accompanying drawings.

Figure 1:
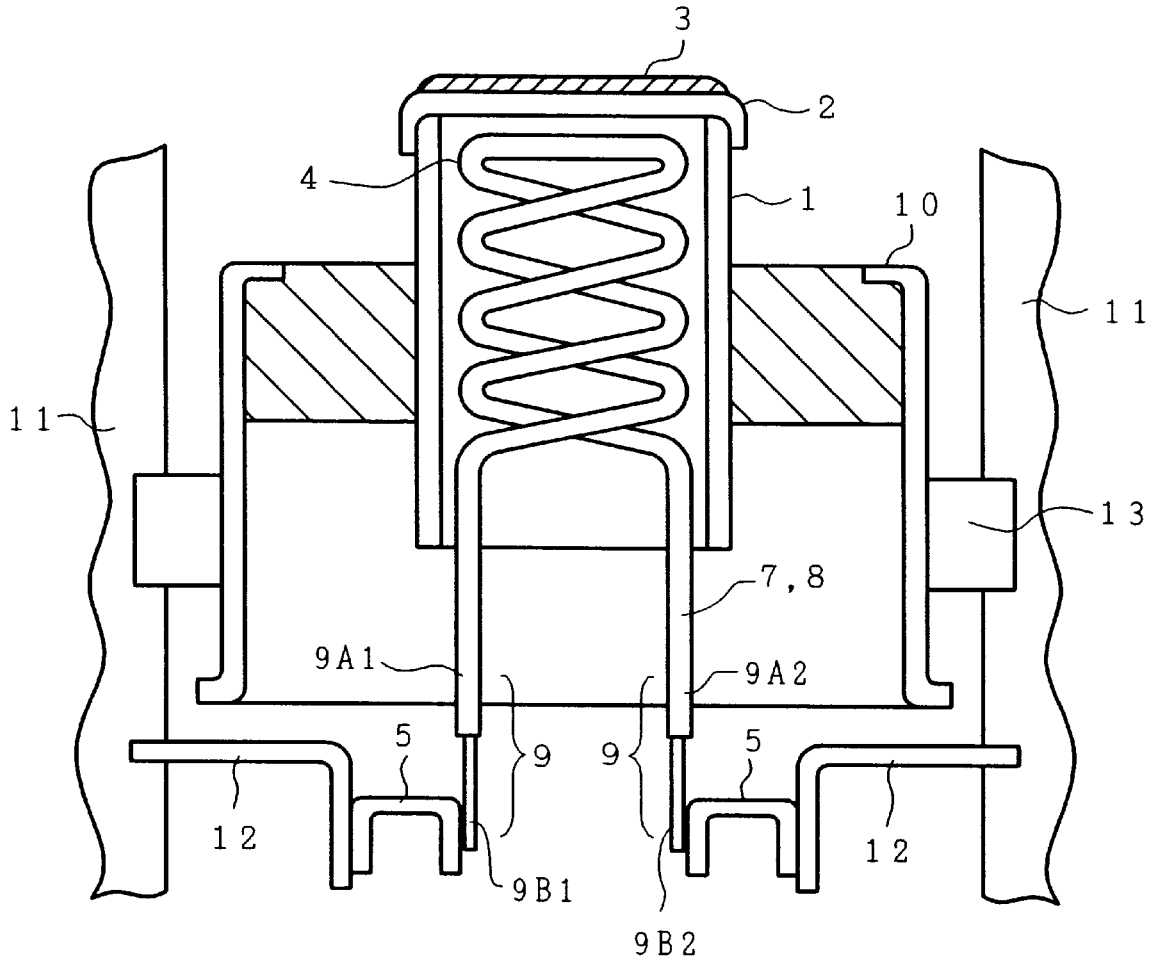
FIG. 1 is a schematic cross-sectional view of principal parts for explaining an embodiment of an indirectly heated cathode structure for a color cathode ray tube according to the present invention.
Figure 2:
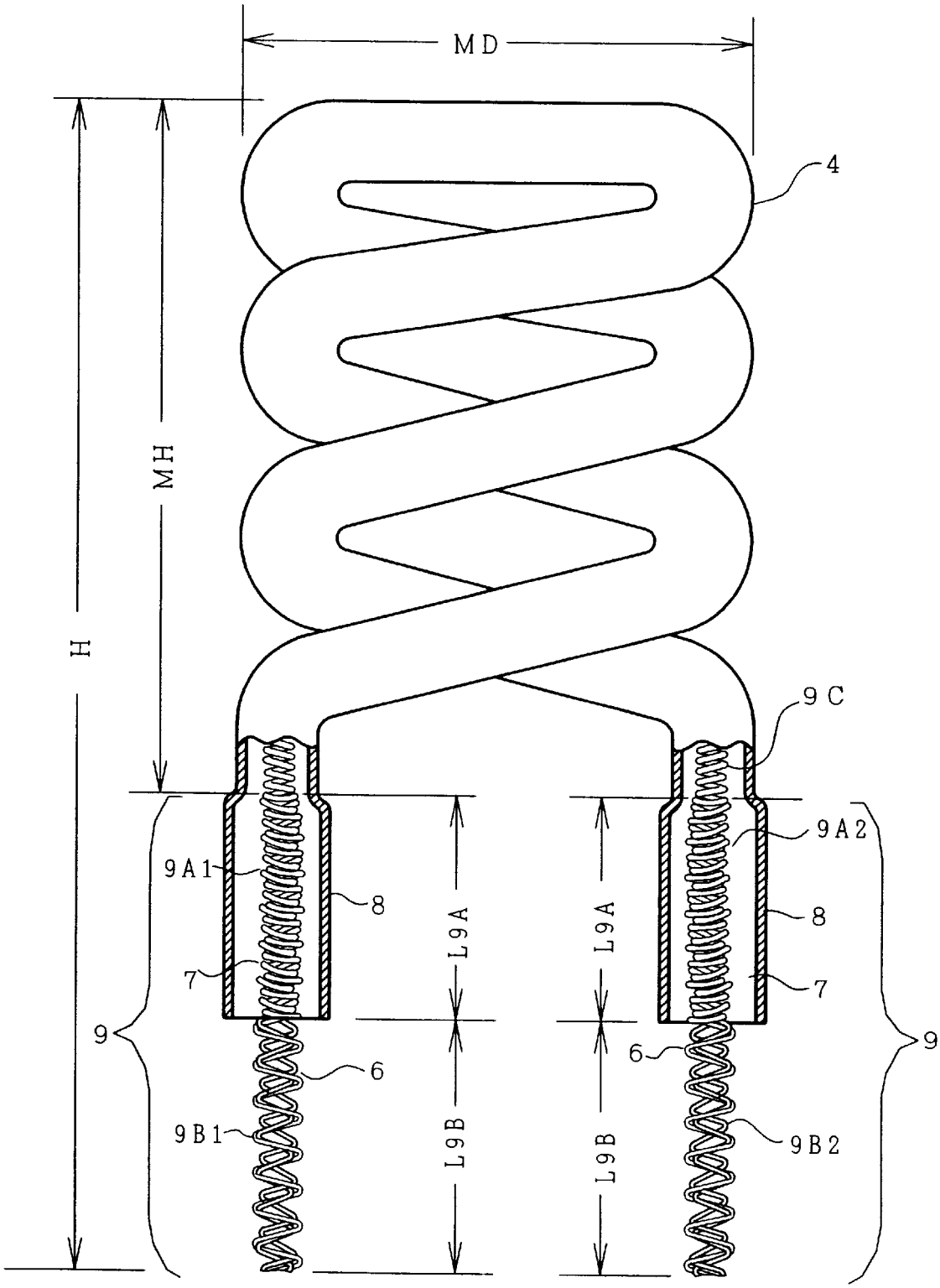
FIG. 2 is a detailed plan view, partly broken away, of the heater used in the embodiment of FIG. 1.
Figure 3A:
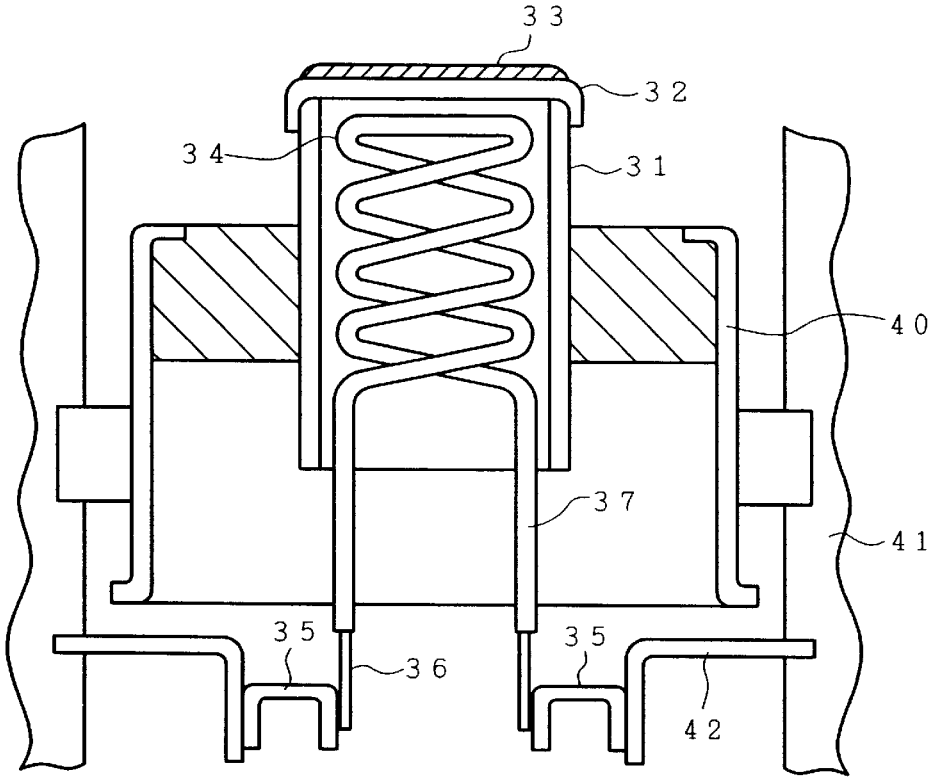
FIG. 3A (PRIOR ART)
FIGS. 3A, 3B and 3C are schematic illustrations of a prior art indirectly heated cathode structure for a cathode ray tube, FIG. 3A being its cross sectional view, FIG. 3B being a plan view, partly broken away, of its heater, and FIG. 3C being an enlarged cross sectional view of a portion of the heater indicated by circle 60 in FIG. 3B.
Figure 3B:
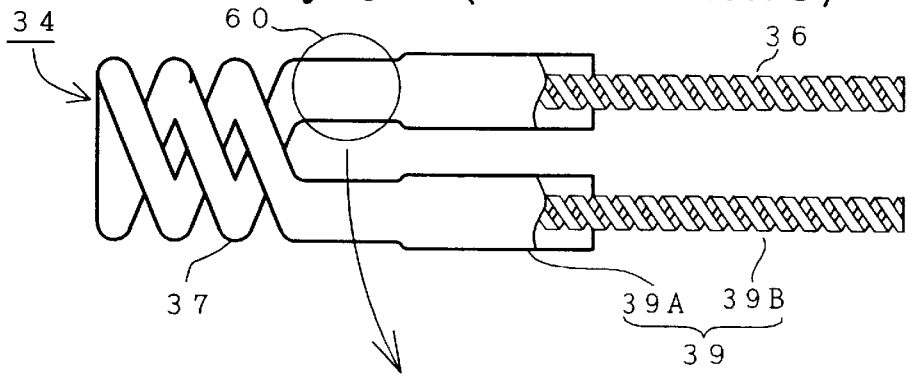
FIG. 3B (PRIOR ART)
Figure 3C:
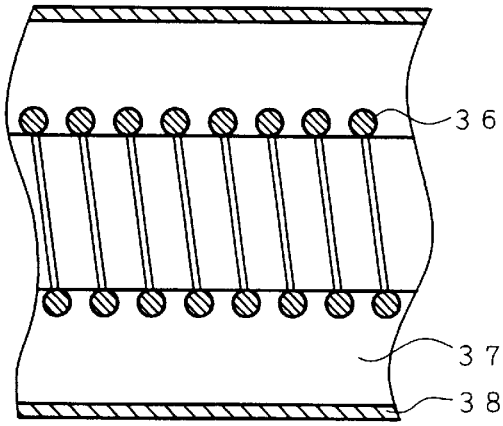
FIG. 3C (PRIOR ART)

FIG. 1 is a schematic cross-sectional view of principal parts for explaining an embodiment of an indirectly heated cathode structure for a color cathode ray tube according to the present invention and FIG. 2 is a detailed plan view, partly broken away, of the heater used in the embodiment of FIG. 1.

In FIGS. 1 and 2, reference numeral 1 denotes a metal sleeve, 2 is a cap-shaped base metal, 3 is an electron emissive material coating, 4 is a heater, 5 is heater supports having the general shape of a square bracket, 6 is a heating wire, 7 is an insulating coating, 8 is a dark color coating, 9 is leg portions of the heater 4, 9A1 and 9A2 are portions of the leg portions 9 covered with the insulating coating 7 and the dark color coating 8, 9B1 and 9B2 are exposed portions of the leg portions 9 which is not covered with the insulating coating 7 and the dark color coating 8, 10 is an outer support sleeve, 11 is glass beads and 12 is support studs.

The cap-shaped base metal 2 is fitted over one end of the metal sleeve 1 and is coated on its outer top surface with an electron emissive material coating 3.

The heater 4 comprises a spirally wound heating wire 6 made of tungsten (W), an insulating coating 7 made of alumina ($Al_2O_3$) and covering the heating wire 6 and a dark color coating 8 made of fine tungsten powders and covering the insulating coating 7.

The heater 4 is provided with a major heating portion 9C formed of the heating wire 6 spirally wound and is inserted into the metal sleeve 1 through its open end. The leg portions 9 formed at both the ends of the heater 4 comprise the covered portion 9A1, 9A2 covered with the insulating coating 7 and the dark color coating 8 and the exposed portion 9B1, 9B2 with the heating wire 6 being uncovered. The exposed portions 9B1, 9B2 are welded to one end of the two heater supports 5, respectively. The other ends of the heater supports 5 are welded to respective studs 12 embedded in the glass beads 11.

The metal sleeve 1 is supported concentrically with and within an outer support metal sleeve 10 which in turn is supported by a pair of glass beads 11 via support tabs 13.

The heater supports 5 are supported by the glass beads 11 via support studs 12 such that the major heating portion 9C of the heater 4 is positioned within the metal sleeve 1.

The heater 4 comprises the major heating portion 9C wound spirally in a single layer and two leg portions 9 wound spirally in three layers and formed of the portions 9A1, 9A2 covered with an insulating coating 7 and the exposed portions 9B1, 9B2 as shown in FIG.2.

Figures 6A, 6B, 6C, 6D:
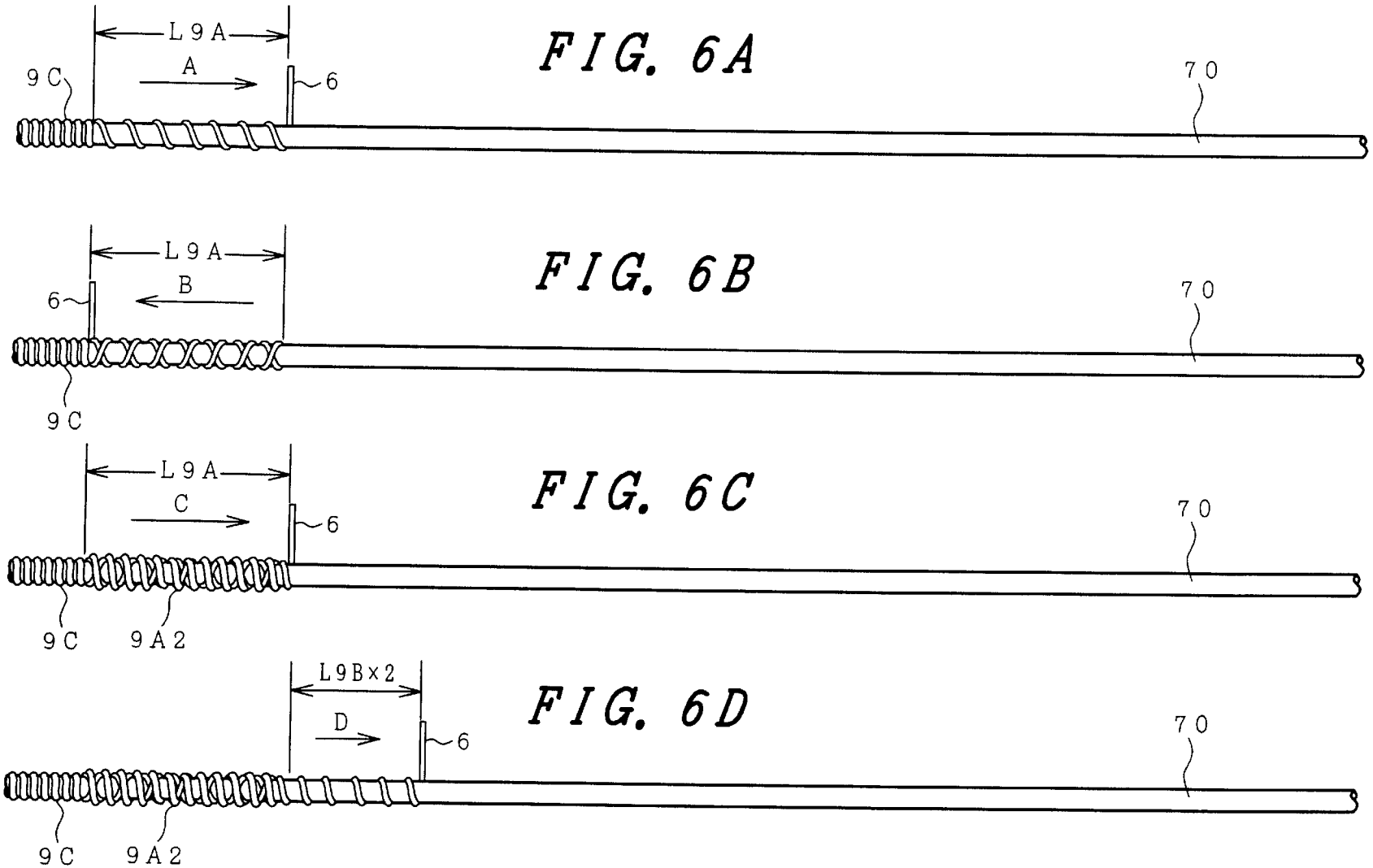
FIGS. 6A–6N are side views for explaining sequences of steps for fabricating a primary winding structure of the present invention.
Figures 6E, 6F, 6G, 6H:
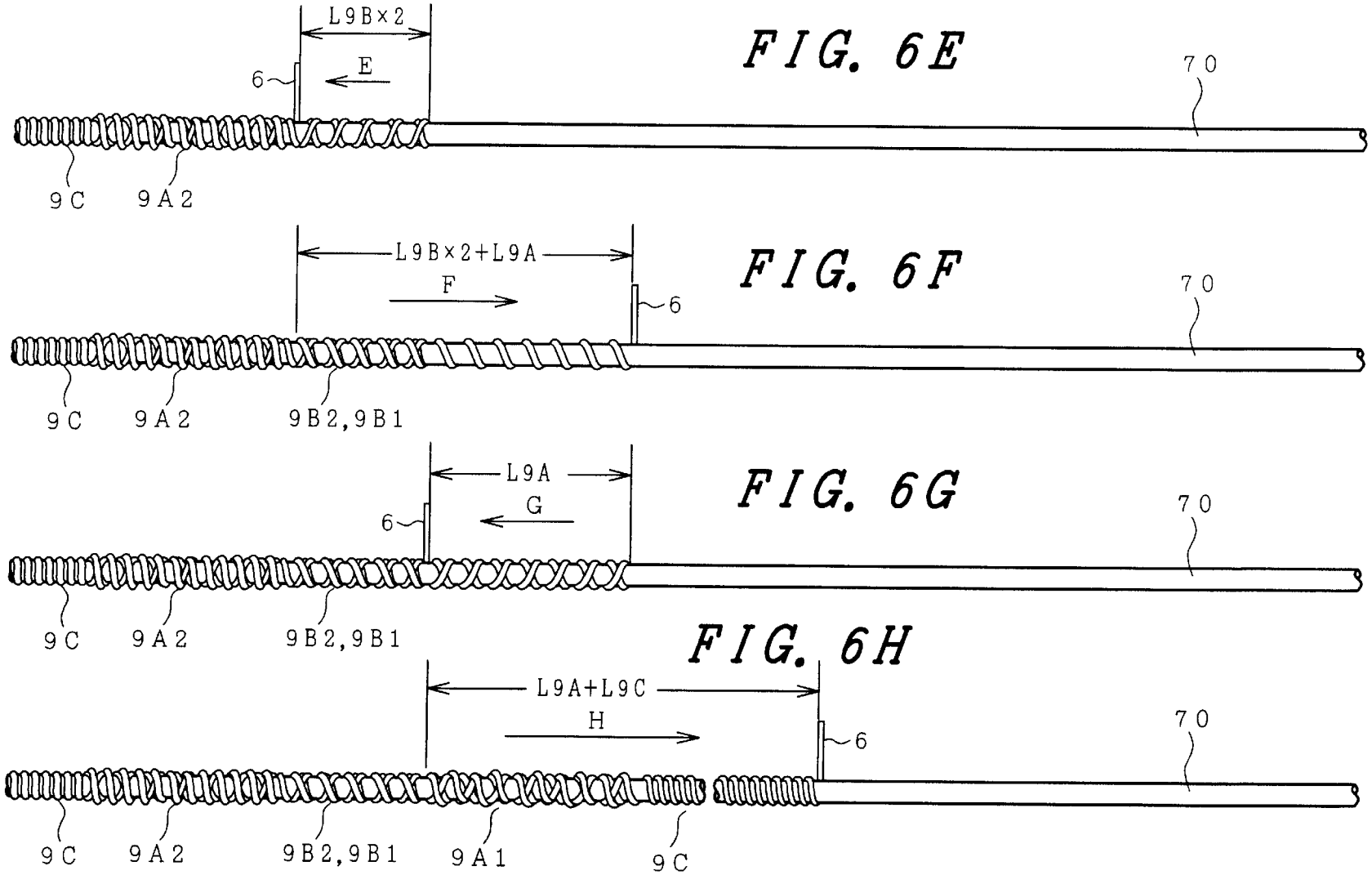
Figure 6I:
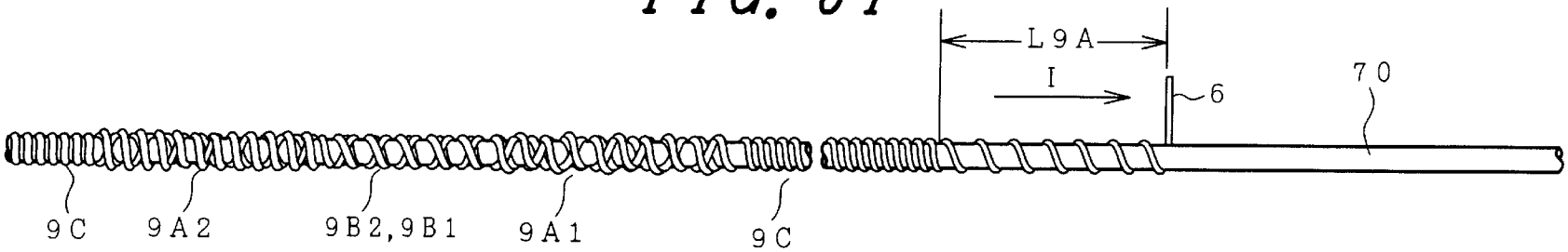
Figure 6J:
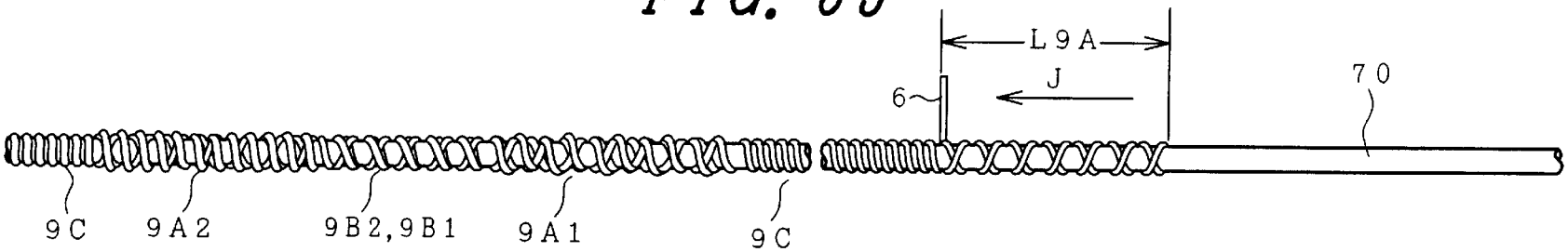
Figure 6K:
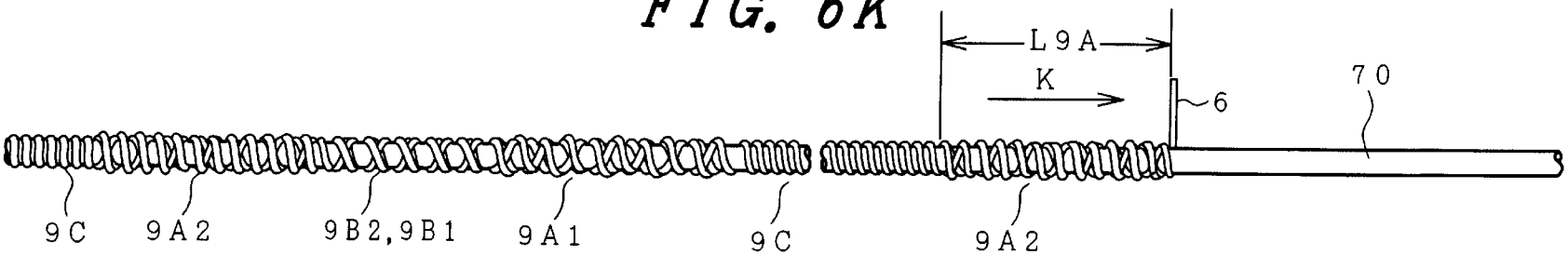
Figure 6L:
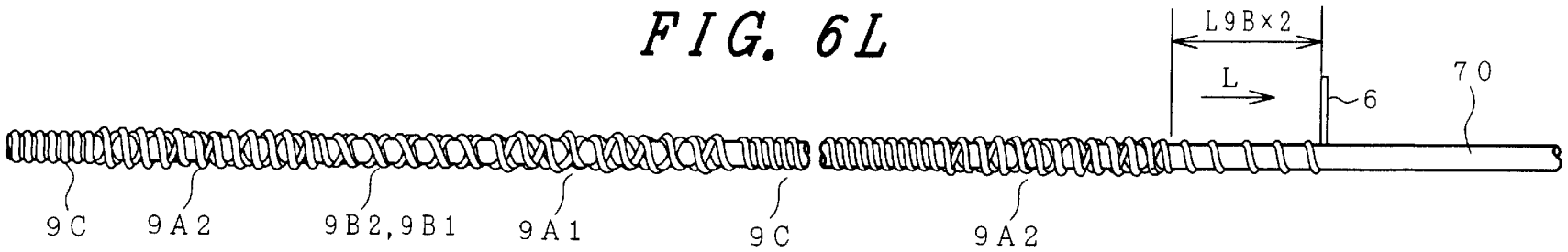
Figure 6M:
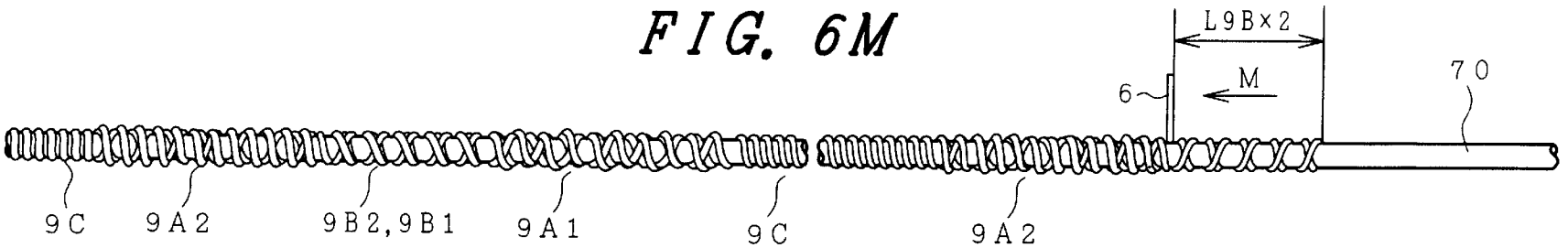
Figure 6N:
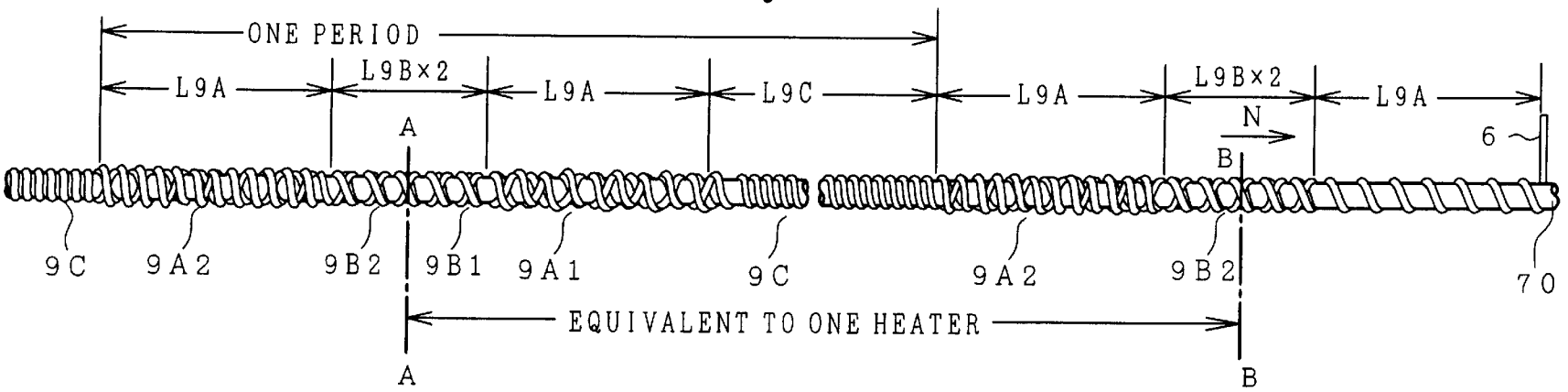

The following explains sequence of steps for continuously fabricating a large number of the primary winding structures of the tungsten heating wire 6 of 0.032 mm in diameter wound spirally around a mandrel 70 of 0.150 mm in diameter and made of molybdenum (Mo) in this embodiment by reference to FIGS. 6A–6N.

FIG. 6A illustrates a process step at a given instant in the continuous fabrication of a large number of the primary winding structures of the tungsten heating wire 6.

Continuously with winding of the major heating portion 9C, the heating wire 6 is wound spirally at a coarse pitch of 4 turns/mm rightward as indicated by an arrow A around the mandrel 70 for the length L9A of the covered portions 9A1, 9A2 (see also FIG. 2).

Next, as illustrated in FIG. 6B, the heating wire 6 is wound spirally at the coarse pitch of 4 turns/mm leftward as indicated by an arrow B for the length 9A around the mandrel 70.

Then, as illustrated in FIG. 6C, the heating wire 6 is wound spirally at a fine pitch of 12 turns/mm rightward as indicated by an arrow C for the length L9A around the mandrel 70 to form the covered portion 9A2 (see also FIG. 2).

Next, as illustrated in FIG. 6D, the heating wire 6 is wound spirally at the coarse pitch of 4 turns/mm rightward as indicated by an arrow D for twice the length L9B of the exposed portions 9B1, 9B2 (see also FIG. 2) around the mandrel 70.

Next, as illustrated in FIG. 6E, the heating wire 6 is wound spirally at the coarse pitch of 4 turns/mm leftward as indicated by an arrow E for twice the length L9B around the mandrel 70.

Then, as illustrated in FIG. 6F, the heating wire 6 is wound spirally at the coarse pitch of 4 turns/mm rightward as indicated by an arrow F for twice the length L9B plus the length L9A around the mandrel 70 to form the exposed portions 9B2, 9B1 (see also FIG. 2).

Next, as illustrated in FIG. 6G, the heating wire 6 is wound spirally at the coarse pitch of 4 turns/mm leftward as indicated by an arrow G for the length L9A around the mandrel 70.

Then, as illustrated in FIG. 6H, the heating wire 6 is wound spirally at the fine pitch of 12 turns/mm rightward as indicated by an arrow H for the length L9A plus the length L9C of the major heating portion 9C around the mandrel 70 to form the covered portion 9A1 and the major heating portion 9C (see also FIG. 2).

Next, as illustrated in FIG. 6I, the heating wire 6 is wound spirally at the coarse pitch of 4 turns/mm rightward as indicated by an arrow I for the length L9A around the mandrel 70.

Next, as illustrated in FIG. 6J, the heating wire 6 is wound spirally at the coarse pitch of 4 turns/mm leftward as indicated by an arrow J for the length L9A around the mandrel 70.

Then, as illustrated in FIG. 6K, the heating wire 6 is wound spirally at the fine pitch of 12 turns/mm rightward as indicated by an arrow K for the length L9A around the mandrel 70 to form the covered portion 9A2 (see also FIG. 2).

Then, as illustrated in FIG. 6L, the heating wire 6 is wound spirally at the coarse pitch of 4 turns/mm rightward as indicated by an arrow L for twice the length L9B around the mandrel 70.

Then, as illustrated in FIG. 6M, the heating wire 6 is wound spirally at the coarse pitch of 4 turns/mm leftward as indicated by an arrow M for twice the length L9B around the mandrel 70.

Then, as illustrated in FIG. 6N, the heating wire 6 is wound spirally at the coarse pitch of 4 turns/mm rightward as indicated by an arrow N for twice the length L9B around the mandrel 70 to form the exposed portion 9B2 (see also FIG. 2).

A piece of the primary winding structure equivalent to one heater is obtained by cutting along the cutoff lines AA and BB in FIG. 6N. Repetition of a period from the process step of FIG. 6A to the process step of FIG. 6H produces a large number of the primary winding structures continuously. In this case the number of layers of winding in the leg portions must be odd and not smaller than three for forming a plurality of the primary winding structures by using a single heating wire continuously.

The heating wire 36 formed into the primary winding structure is again wound spirally as shown in FIG. 2 to form the major heating portion of the heater 4 to be positioned within the metal sleeve 1. This structure of the large-diameter (MD) spiral winding of the heating wire 6 is hereinafter referred to as the secondary winding structure.

The heating wire 6 of the secondary winding structure is coated with alumina ($Al_2O_3$) except for the exposed portions 9B1, 9B2 of the leg portions 9 of the heater 4 which in turn is covered with fine tungsten (W) powders 8, to form the shape of the heater 4 as shown in FIG. 2, and then is fired at a high temperature, 1650° C., for example. Then the fired heater 4 is immersed in a mixed solution of hydrochloric acid (HCl) and nitric acid ($HNO_3$) to dissolve and remove the Mo mandrel and to complete the heater 4.

In the heater 4 of the above construction, the exposed portions 9B1, 9B2 comprise superposition of three layers of the heating wire 6 wound at a coarse pitch of 4 turns/mm and the covered portions 9A1, 9A2 of the leg portions 9 comprise superposition of one layer of the heating wire 6 wound at a fine pitch of 12 turns/mm and two layers of the heating wire 6 wound at a coarse pitch of 4 turns/mm.

In this structure, the numbers of turns per unit length of the three layers are added together, the number of turns per unit length in the exposed portions 9B1, 9B2=3×4 turns/mm=12 turns/mm, and the number of turns per unit length in the covered portions 9A1, 9A2=(1×12 turns+2×4 turns)/mm=20 turns/mm.

Consequently the mechanical strength of the exposed portions 9B1, 9B2 of this embodiment is made weaker than that of the prior art heater of the similar kind. This reduces the transmission of stresses caused by heat of welding from the exposed portions 9B1, 9B2 to other portions of the heater 4 during the operation of welding the exposed portions 9B1, 9B2 to the heater supports 5 in fabrication of the indirectly heated cathode structure, and greatly reduces occurrences of damage such as cracks in the insulating coating 7 in the covered portions 9A1, 9A2 and in a portion other than the leg portions 9. Great reduction of flakes from the insulating coating 7 damaged by turning on the heater 4 greatly reduces deterioration of performance of cathode ray tubes caused by scattering of the flakes within its vacuum envelope.

In the above embodiment of the heater 4, the exposed portions 9B1, 9B2 comprise superposition of three layers of the heating wire 6 wound at a coarse pitch of 4 turns/mm and the covered portions 9A1, 9A2 of the leg portions 9 comprise superposition of one layer of the heating wire 6 wound at a fine pitch of 12 turns/mm and two layers of the heating wire 6 wound at a coarse pitch of 4 turns/mm, but the winding construction of the heating wire 6 of the heater 4 in the present invention is not limited to such construction, and the present invention can employ other winding construction such as a combination of the exposed portions 9B1, 9B2 comprising superposition of three layers of the heating wire 6 wound at a coarse pitch of 4 turns/mm and the covered portion 9A1, 9A2 of the leg portions 9 comprising superposition of two layers of the heating wire 6 wound at a fine pitch of 12 turns/mm and one layer of the heating wire 6 wound at a coarse pitch of 4 turns/mm.

In the above embodiment, 4 turns/mm is adopted as a coarse pitch of winding of the heating wire 6, and 12 turns/mm is adopted as a fine pitch of winding of the heating wire 6, but the pitches of winding of the heating wire of the present invention is not limited to such values. Other values of pitches can be employed if a coarse pitch of winding of the heating wire makes the mechanical strength of the uncovered portion of the leg portions insufficient to transmit unacceptable stresses from the uncovered portion to other portions of the heater. It is preferable that the value of a coarse pitch is set to be not smaller than twice the value of a fine pitch. Also the number of layers of winding in the present invention is not limited to three.

As described above, in accordance with the present invention, the heating wire in the exposed (uncovered) portion of the leg portions of the heater is wound with the number of turns per unit length smaller than the number of turns per unit length in the covered portion of the leg portions such that the mechanical strength of the exposed portion is weaker than that of the corresponding portion of the prior art heater. Consequently, this structure reduces the transmission of stresses caused by heat of welding from the exposed portion to other portions of the heater during the operation of welding the exposed portions to the heater supports in fabrication of the indirectly heated cathode structure, and greatly reduces occurrences of damage such as cracks in the insulating coating in the covered portion of the leg portion and in a portion other than the leg portion. Great reduction of flakes from the insulating coating damaged by turning on the heater 4 greatly reduces deterioration of performance of cathode ray tubes caused by scattering of the flakes within its vacuum envelope.

Dimensional examples for the structure of FIG. 2 are:

the diameter MD of the secondary winding structure 1.3 mm, the height MH of the secondary winding structure 3.8 mm, the length L9A of the covered portions 9A1, 9A2=7.0 mm, and the length L9B of the exposed portions 9B1, 9B2=2.3 mm.

It is not necessary that the transition in the number of turns per unit length of winding coincides exactly with the boundary between the covered portion and the exposed portion.

The present invention is different only in pitches of winding of the heating wire from the prior art heater and therefore provides advantages that the present invention does not increase the cost or deteriorate mass productivity.

What is claimed is:

1. A cathode ray tube comprising:

an evacuated envelope including a panel portion, a neck portion, a funnel portion for connecting said panel portion and said neck portion and a stem having a plurality of pins therethrough being sealed to close said neck portion at one end thereof, a phosphor screen formed on an inner surface of said panel portion, an electron gun housed in said neck portion, said electron gun comprising an indirectly heated cathode structure and a plurality of grid electrodes disposed downstream of said cathode structure, spaced specified distances apart, arranged axially in a specified order, and fixed by insulating rods, said indirectly heated cathode structure comprising a metal sleeve, a base metal having an electron emissive material coating on an outer top surface thereof and attached at one end of said metal sleeve, and a heater positioned within said metal sleeve, said heater comprising a major heating portion having a spirally wound heating wire and a pair of leg portions connected to opposite ends of said major heating portion, said major heating portion and an inner portion of each of said pair of leg portions on a major-heating-portion side thereof are covered with an insulating coating, said heater being welded to electrical conductors for applying a voltage thereto at an outer portion of each of said pair of leg portions, said outer portion not being covered with said insulating coating, said outer portion of each of said pair of leg portions includes a first multilayer winding portion having heating wires wound spirally in a plurality of layers, said inner portion of each of said pair of leg portions includes a second multilayer winding portion having heating wires wound spirally in a plurality of layers, and a number of turns per unit length in said first multilayer winding portion is smaller than that in said second multilayer winding portion.

2. A cathode ray tube according to claim 1, wherein each of said first and second multilayer winding portions has said heating wires wound spirally in an odd number and is not less than three layers.

3. A cathode ray tube according to claim 1, wherein said second multilayer winding portions are formed of a plurality of layers having said heating wires wound spirally with at least two different numbers of turns per unit length from each other.

4. A cathode ray tube according to claim 1, wherein said first and second multilayer winding portions are wound spirally in three layers.

5. A cathode ray tube according to claim 1, wherein said first multilayer winding portion comprises three layers of said heating wires spirally wound with a first number of turns per unit length, said second multilayer winding portion comprises two layers of said heating wires spirally wound with a second number of turns per unit length and one layer of said heating wire spirally wound with said first number of turns per unit length, and said first number of turns per unit length is smaller than said second number of turns per unit length.

6. A cathode ray tube according to claim 1, wherein said first multilayer winding portion comprises three layers of said heating wires spirally wound with a first number of turns per unit length, said second multilayer winding portion comprises two layers of said heating wires spirally wound with said first number of turns per unit length and one layer of said heating wire spirally wound with a second number of turns per unit length, and said first number of turns per unit length is smaller than said second number of turns per unit length.

7. A cathode ray tube according to claim 1, wherein said number of turns per unit length in said first multilayer winding portion is equal to or smaller than half of said number of turns per unit length in said second multilayer winding portion.

* * * * *